US006087894A

United States Patent [19]

Barrett, Jr. et al.

[11] Patent Number: 6,087,894

[45] Date of Patent: Jul. 11, 2000

[54] LOW POWER PRECISION CURRENT REFERENCE

[75] Inventors: Raymond Louis Barrett, Jr., Ft. Lauderdale; Barry W. Herold, Delray Beach; Scott Humphreys, Boynton Beach; Lawrence L. Case, Lake Worth, all of Fla.

[73] Assignee: Motorola, Inc., Schaumburg, Ill.

[21] Appl. No.: 09/032,877

[22] Filed: Mar. 2, 1998

[51] Int. Cl.[7] ..... G05F 3/02

[52] U.S. Cl. ..... 327/543; 327/538; 323/315; 323/316

[58] Field of Search ..... 323/312, 313, 323/315, 316; 327/530, 538, 540, 541, 543, 534

[56] References Cited

U.S. PATENT DOCUMENTS

| | | | |
|---|---|---|---|
| 5,045,773 | 9/1991 | Westwick et al. | 323/316 |
| 5,221,888 | 6/1993 | Moody | 323/315 |
| 5,376,839 | 12/1994 | Horiguchi et al. | 323/316 |

OTHER PUBLICATIONS

J. P. Colinge, "Silicon on Insulator Technology: Materials to VLSI," published by Klower Academic Press, 1991, pp. 166–168.

Paul Richman, "MOS Field–Effect Transistors and Integrated Circuits," published by John Wiley and Sons, 1973, pp. 32 through 43.

*Primary Examiner*—Jung Ho Kim

*Attorney, Agent, or Firm*—James A. Lamb

[57] ABSTRACT

A first complementary metal oxide semiconductor (CMOS) current reference circuit (100, 500) has a first and a second current mirror (110, 150) and is implemented using one of bulk wafer technology and silicon on insulator (SOI) technology. The first current mirror (110) has an output stage (130) that includes at least one cascode coupled field effect transistor (FET) (125) having one of a source tied well (when implemented using bulk wafer technology) or a source tied body (when implemented using SOI technology). A second CMOS current reference circuit (600, 800) has a first and a second current mirror (650, 610) and is implemented using SOI technology. The first current mirror (650) has a first bias FET (161) having a gate tied body.

14 Claims, 6 Drawing Sheets

100

FIG. 2
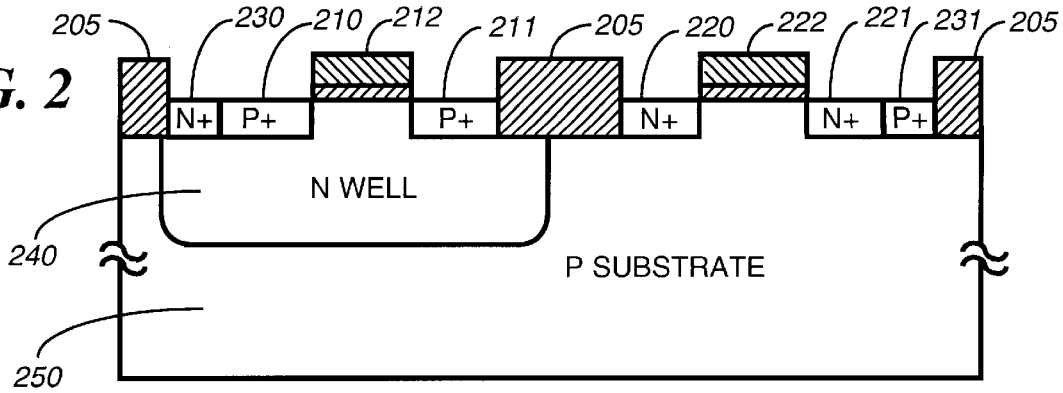
FIG. 3
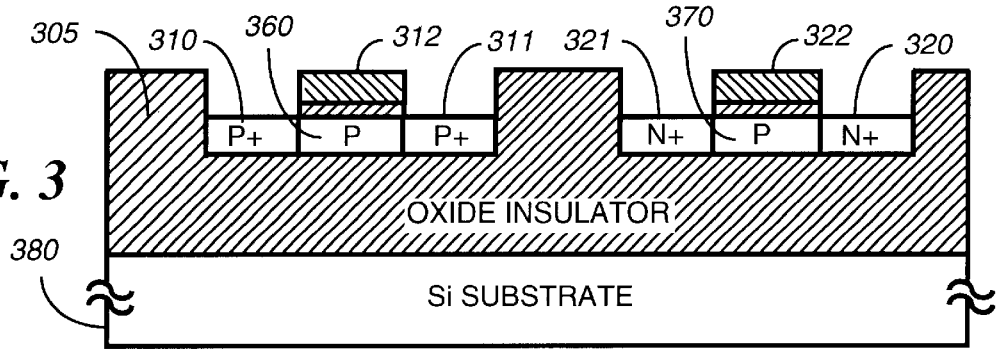
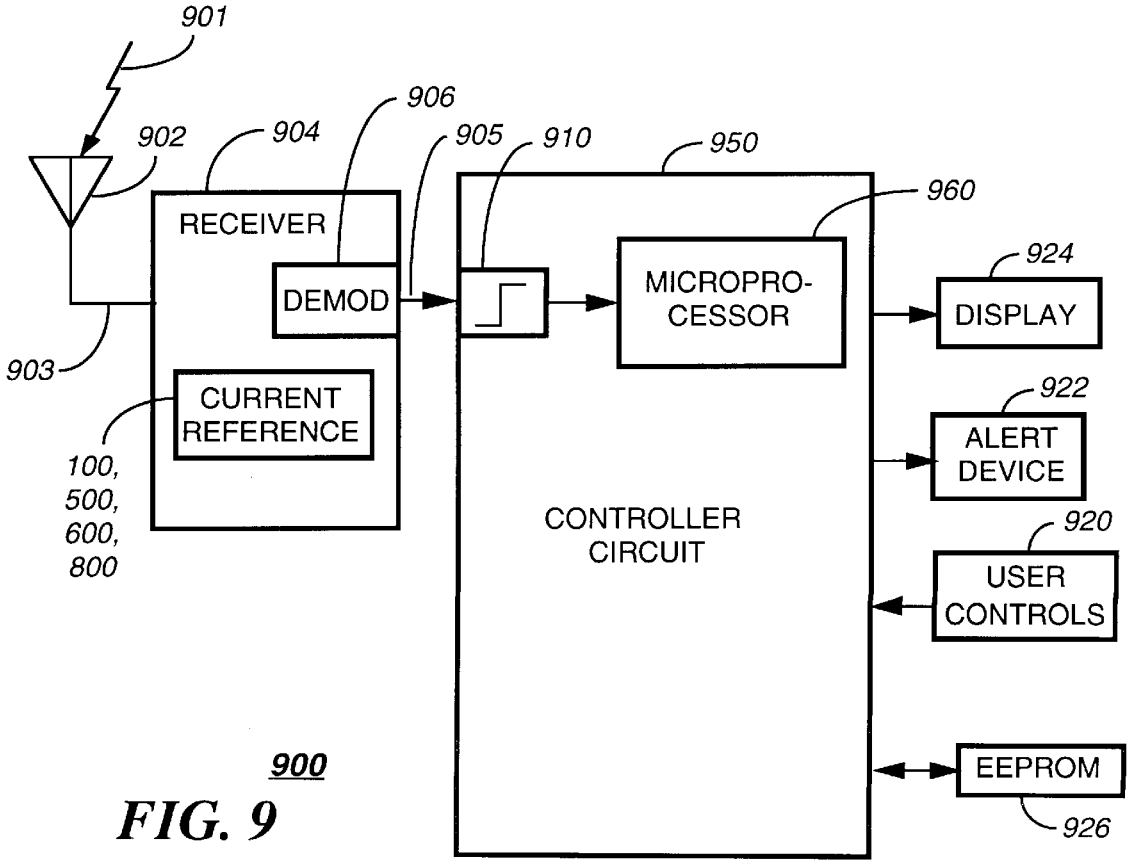
FIG. 9

600

LOW POWER PRECISION CURRENT REFERENCE

FIELD OF THE INVENTION

This invention relates in general to current reference circuits used in integrated circuits and in particular to CMOS current reference circuits that are designed using current mirrors.

BACKGROUND OF THE INVENTION

Power requirements and size are critical design parameters in portable electronic devices such as pagers and broadcast frequency modulation (FM) radio receivers. In an increasingly energy conscious world, these two design parameters are also important in other electronic devices that operate when plugged into an alternating current (AC) supply.

A circuit that is useful within integrated circuits in such devices is a current reference circuit. Such a circuit is particularly useful in analog computation circuits, particularly when variables being used for computation are expressed as a current, a ratio of currents, or as related to a bias current. It is commonplace to provide a circuit which acts as a reference by starting up automatically and maintaining a substantially constant current, even though a power source supplying the current has a voltage that varies. Typical of such circuits are feedback circuits that depend on a gain non-linearity to stabilize at a reference current. The non-linearity establishes a loop gain that is greater than one for small currents and less than one for larger currents. The feedback circuit then reaches a steady state reference value where the loop gain is one. In current mirror circuits, a resistor is typically used to achieve this type of gain non-linearity in one of a feed forward current mirror or feedback current mirror in the feedback circuit. This is accomplished by using the resistor to alter the current-versus-voltage performance (wherein the voltage is a gate to source voltage of a bias transistor) of either a mirror input or output stage in one of the feed forward or feedback current mirrors. The transistors in the input and output stages in a typical current mirror have non-linear diode current-versus-voltage characteristics that are very well matched, and the typical current mirror thereby provides a gain that is essentially constant over an operational voltage range. The resistor modifies the diode characteristics of one or more transistors in one of the input or output stages of either or both of the feed forward and feedback current mirrors, thus providing the desired non-linear gain characteristic that includes a unity gain. However, using a resistor has a drawback in that they are physically very large compared to the size of transistors in modern day integrated circuits. The physical size of such a resistor can easily exceed the size of the all the transistors used in such a feedback reference circuit, and there are also difficulties in matching to a particular transistor characteristic in order to achieve the desired non-linear gain, and in trying to minimize their variation over temperature changes.

Thus, what is needed is a current reference circuit that is small, requires little power to operate, and has no resistors.

BRIEF DESCRIPTION OF THE DRAWINGS

FIG. 2 shows a cross sectional diagram of a p-channel FET and an n-channel FET that are fabricated using a bulk silicon wafer technology, in accordance with the preferred embodiment of the present invention.

FIG. 3 shows a cross sectional diagram of a p-channel FET and an n-channel FET that are fabricated using one type (thin-film) of SOI wafer technology, in accordance with the first alternative embodiment of the present invention.

FIG. 9 shows an electrical block diagram of a radio, in accordance with the preferred and alternative embodiments of the present invention.

DETAILED DESCRIPTION OF THE PREFERRED EMBODIMENT

Figure 1:
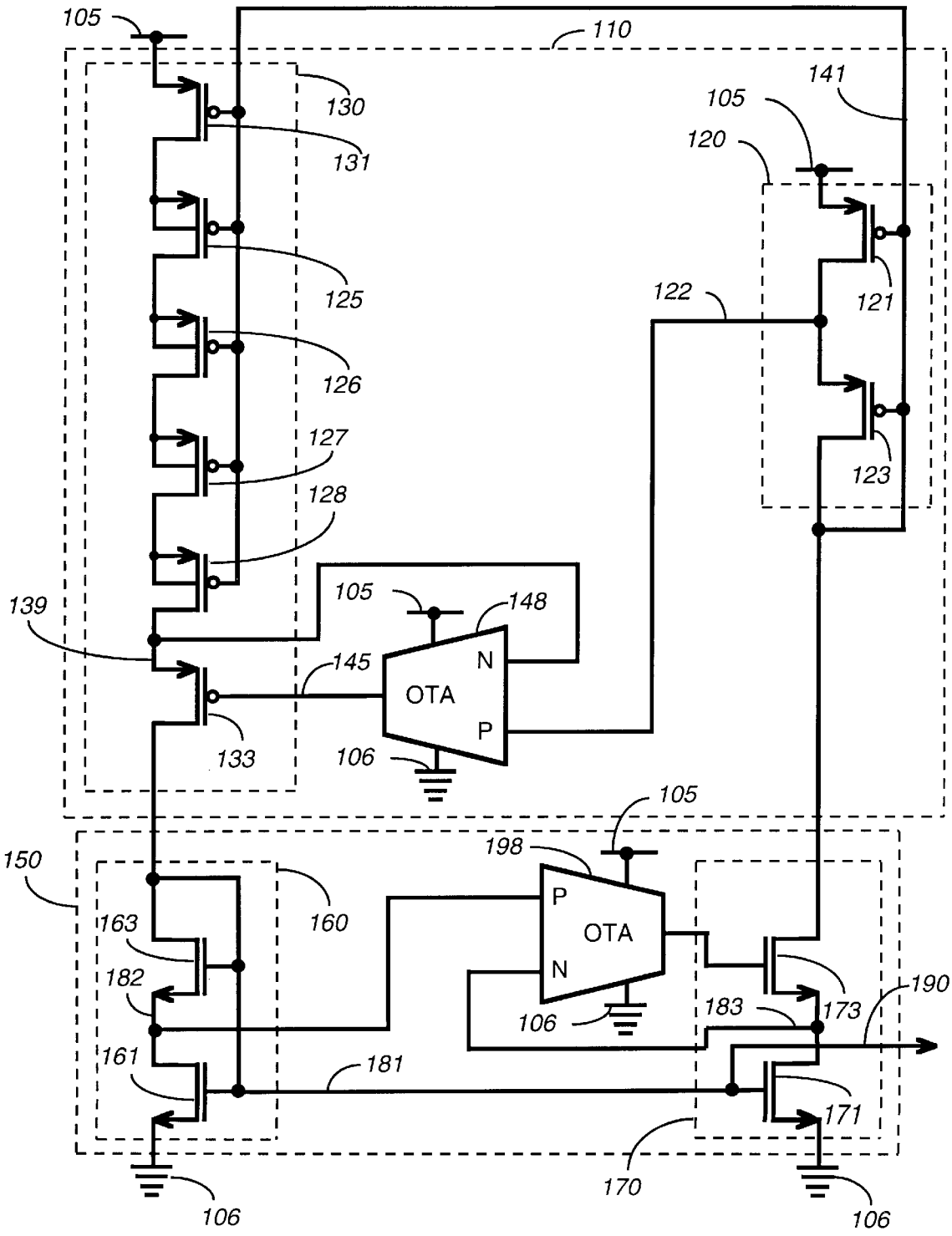
FIG. 1 shows an electrical schematic of a complementary metal oxide semiconductor (CMOS) current reference circuit, in accordance with a preferred and first alternative embodiment of the present invention.

All transistors described herein are field effect transistors (FETs) that are conventional in the sense that they each have a gate, a source, and a drain. Characteristics of the FETs described herein are determined in a conventional manner at the time of circuit design, by selecting channel lengths, channel widths, and an instantiation value for each FET. The instantiation value is an integer designating how many fundamental transistors are coupled in parallel (gate to gate, source to source, drain to drain, and well contact to well contact (when well contacts exists) or body contact to body contact (when body contacts exist) to form any particular FET that is illustrated in the schematics of FIGS. 1, 5, 6, and 8 by a single transistor symbol. For example, FET 171 in FIG. 1 represents a transistor that preferably has a channel length 16 and channel width 16 and instantiation value 7, and is thus formed from 7 fundamental transistors connected in parallel, each having a channel length of 16 and channel width of 16. In accordance with conventional design practices, channel lengths and widths are given as numbers that are multiples of a reference length or reference width.

Referring to FIG. 1, an electrical schematic of a complementary metal oxide semiconductor (CMOS) current reference circuit 100 is shown, in accordance with a preferred and first alternative embodiment of the present invention. The CMOS current reference circuit 100 produces an internal reference current and a reference bias output 190, but another bias in the circuit can also be used as a reference bias output, as will be described below. Each of the reference bias outputs can be used to provide replicate currents in other current mirror circuits that are precisely proportional to the internal reference current, using conventional current mirror techniques.

The CMOS current reference circuit 100 comprises a first current mirror 110 and a second current mirror 150. The first current mirror 110 comprises a first input stage 120 and a first output stage 130. The first input stage 120 comprises a first diode connected FET 123 of a first type (p-channel) cascode coupled with a first bias FET 121 of the first type. The source of the first bias FET 121 is coupled to a first supply voltage 105, which in this example is a supply voltage of a power source (not shown in FIG. 1) that is positive with respect to a second supply voltage 106 of the power source, which in this example is ground. Preferably, the power source is a battery such as two conventional AAA cells in series. As used herein, "diode connected" means that the gate of a FET is tied to the drain of the FET, and "cascode coupled" means the source of a FET of one type (p-channel or n-channel) is coupled to a drain of another FET of the same type which is either also cascode coupled or has its source coupled to a supply voltage.

The first output stage 130 comprises a plurality of FETs of the first type coupled in a cascode configuration. In this example, the plurality of FETs comprises a first mirror bias FET 131, four cascode coupled FETs 125, 126, 127, 128, and a cascode coupled first output FET 133. The gates of the first bias FET 121, the first diode connected FET 123, the first mirror bias FET 131, and the cascode coupled FETs 125, 126, 127, 128 are coupled together and share a first bias node 141. The first current mirror 110 also comprises a first differential operational transconductance amplifier (OTA) 148 that has differential inputs: a non-inverting input that is coupled to a node 122 that includes the source of the first diode connected FET 123 and an inverting input that is coupled to a node 139 that includes the source of the first output FET 133. The first differential OTA 148 has a first OTA output 145 coupled to the gate of the first output FET 133. The first differential OTA 148 is powered by the first and second supply voltages 105, 106.

The second current mirror 150 comprises a-second input stage 160 and a second output stage 170. The second input stage 160 comprises a second diode connected FET 163 of a second type (n-channel), cascode coupled with a second bias FET 161 of the second type. The source of the second bias FET 161 is coupled to the second supply voltage 106 (ground in this example).

The second output stage 170 comprises a second mirror bias FET 171 of the second type cascode coupled with a second output FET 173 of the second type. The gates of the second bias FET 161, the second diode connected FET 163, and the second mirror bias FET 171 are coupled together and share a second bias node 181, at which the reference bias output 190 is provided. The second current mirror 150 also comprises a second differential operational transconductance amplifier (OTA) 198 that has differential inputs: a noninverting input that is coupled to a node 182 that includes the source of the second diode connected FET 163 and an inverting input that is coupled to a node 183 that includes the source of the second output FET 173. The second differential OTA 198 has a second OTA output coupled to the gate of the second output FET 173. The second differential OTA 198 is powered by the first and second supply voltages 105, 106.

The drain of the first output FET 133 is coupled to the second bias node 181 and the drain of the second output FET 173 is coupled to the first bias node 141, thereby coupling the second current mirror 150 to the first current mirror 110 in a closed loop current feedback configuration.

The CMOS current reference circuit 100 is preferably fabricated using bulk silicon wafer technology. Referring to FIG. 2, a cross sectional diagram of a p-channel FET and an n-channel FET that are fabricated using the bulk silicon wafer technology is shown, in accordance with the preferred embodiment of the present invention. The substrate is a P doped substrate 250 having an N doped well 240. The p-channel FET comprises a source 210, a drain 211, and a gate 212. A channel is formed in the N well 240 just below the gate 212 during operation of the p-channel FET. The p-channel FET comprises a well contact 230 that couples a voltage bias to the N well 240. The n-channel FET comprises a source 220, a drain 221, and a gate 222. A channel is formed in the P substrate 250 just below the gate 222 during operation of the n-channel FET. The n-channel FET comprises a substrate contact 231 that couples a voltage bias to the P substrate 250. Oxide insulators 205 isolate portions of the circuit and prevent unwanted leakage currents.

In a conventional CMOS circuit fabricated using bulk silicon wafer technology, the well contact 230 is typically coupled to the source 210, which is described as a source tied well. The source tied wells of all p-channel FETs are typically coupled in common to a positive supply voltage, and the P substrate 250 is typically coupled to a ground through the substrate contact 231. However, in accordance with the preferred embodiment of the present invention, each of the well contacts 230 of the FETs 125, 126, 127, 128 is coupled to the respective source 210 of each of the FETs 125, 126, 127, 128, but is not coupled in common with the bodies of any other FETs, nor any supply voltages in the CMOS current reference circuit 100. The bias on each of the wells 240 of the FETs 125, 126, 127, 128 is thereby isolated from the bias of the bodies of all other FETs in the P substrate 250. Each of the FETs 125, 126, 127, 128 is therefore described herein as a FET having an isolated source tied well. Each of the first diode connected FET 123, the first bias FET 121, the first mirror bias FET 131, and the first output FET 133 has its well 240 coupled in a conventional manner to the first supply voltage 105, and therefore does not have isolated source tied wells. The P substrate, which is common to the second diode connected FET 163, the second bias FET 161, the second mirror bias FET 171 and the second output FET 173 is coupled to the second supply voltage (ground, in this example). The P substrate is non-isolatable as a consequence of its being an electrically unified substrate. The first and second differential OTAs 148, 198 are of conventional design; the FETs used therein have their wells 240 of the p-channel FETs coupled to the first power supply (and the P substrate 250 is coupled to the second power supply).

The CMOS current reference circuit 100 is alternatively fabricated using silicon on insulator (SOI) wafer technology. Referring to FIG. 3, a cross sectional diagram of a p-channel FET and an n-channel FET that are fabricated using one type (thin-film) of SOI wafer technology is shown, in accordance with the first alternative embodiment of the present invention. A silicon substrate 380 is used for structural support. The silicon substrate 380 has an upper portion that is chemically altered to be an insulator 305, in a conventional manner. The p-channel FET comprises a source 310, a drain 311, and a gate 312. A channel is formed in a body 360 just below the gate 312 during operation of the p-channel FET. The body 360 is formed from P doped silicon, and has a conductive contact that is not shown in the cross sectional view of FIG. 3. The body 360 is identified as a first body 360 because it is the body of a first type (p-channel) FET. The n-channel FET comprises a source 320, a drain 321, and a gate 322. A channel is formed in a body 370 just below the gate 322 during operation of the n-channel FET. The body 360 is formed from P doped silicon (the amount of doping is typically different in the body 360 from the amount of doping in the body 370), and has a conductive contact that is not shown in the cross sectional view of FIG. 3. The body 370 is identified as a second body 370 because it is the body of a second type (n-channel) FET.

In a conventional CMOS circuit fabricated using SOI silicon wafer technology, the first body 360 is typically left floating or else is coupled to the source 310 of the p-channel FET, which is described herein as being a source tied body. Typically, all source tied bodies of p-channel FETs are coupled in common to a positive supply voltage. Similarly, the second body 370 is typically left floating or else is source tied. The source tied bodies of n-channel FETs are typically coupled in common to a ground. However, in accordance with the first alternative embodiment of the present invention, each of the first bodies 360 of the FETs 125, 126, 127, 128 is coupled to the respective source 310 of the FETs 125, 126, 127, 128, but not is not coupled in common with the first bodies 360 and sources 310 of any other FETs in the CMOS current reference circuit 100. Each of the first bodies of the FETs 125, 126, 127, 128 FETs is thereby isolated from the bodies of all other FETs in the substrate 380. Each of the FETs 125, 126, 127, 128 is therefore described herein as a FET having an isolated source tied body. Each of the first diode connected FET 123, the first bias FET 121, the first mirror bias FET 131, and the first output FET 133 has its first body 360 coupled in common to the first supply voltage 105 in a conventional manner. Each of the second diode connected FET 163, the second bias FET 161, the second mirror bias FET 171 and the second output FET 173 has its second body 370 coupled in common to the second supply voltage 106 (ground, in this example). The first and second differential OTAs 148, 198 are of conventional design; the FETs used therein have the first bodies 360 of the p-channel FETs coupled to the first power supply and the second bodies 370 coupled to the second power supply.

It will be appreciated that the CMOS current reference circuit 100 can be equally well implemented using other SOI wafer technology.

The unique coupling of the FETs 125, 126, 127, 128 in the first output stage 130 results in a non-linear current gain of the first current mirror 110. The unique coupling of the FETs 125, 126, 127, 128 includes their cascode coupling to one another and to the first mirror bias FET 131, the cascode coupling of the first output FET 133 to one of them, their isolated source tied wells (in accordance with the preferred embodiment of the present invention), their isolated source tied bodies (in accordance with the first alternative embodiment of the present invention), and the common coupling of their gates to the first bias node 141. The current gain of the first current mirror 110 is the ratio of an output current passing through the first output stage 130 to an input current passing through the input stage 120. The effect of substrate bias in altering the threshold of MOS transistors is described in pages 32 through 43 of a book by Paul Richman, "MOS Field-Effect Transistors and Integrated Circuits," published by John Wiley and Sons, 1973. It will be appreciated that the use of an isolated source tied well or isolated source tied body alters the current to voltage performance of each of the FETs 125, 126, 127,128 (wherein the voltage is the gate to source voltage), with a cumulative effect of causing sufficient non-linearity of the otherwise constant to achieve the desired result of a single, stable reference current and bias. The current gain of the first current mirror 110 over an input current range of 0 to 1.0 microamperes can be characterized as a constant negative gain (a loss) over the entire range, modified by a small positive gain at very low currents and a small negative gain at higher currents. The current gain of the second current mirror 150 is very constant over the same range. The constant current gain of the second current mirror 150 is designed to compensate for the constant negative gain of the first current mirror 110. The net result is that the total loop gain of the first and second current mirrors 110, 150 is greater than 1.0 at low currents and less than 1.0 at higher currents (less than 1.0 microamperes).

The number of FETs having isolated source tied wells or isolated source tied bodies used in the first output stage 130 and the amount of constant gain provided in the second current mirror 150 is preferably determined, when the CMOS current reference circuit 100 is designed, so that a minimum number of FETs having isolated source tied wells or isolated source tied bodies is used that guarantees that a current gain ratio of one (i.e., unity open loop current gain) exists at essentially one and only one voltage, for all possible voltages (from zero to a maximum supply voltage) on the first bias node 141 for the CMOS current reference circuit 100. The minimum number of FETs having isolated source tied wells or bodies and the constant gain of the second current mirror 150 are determined by variables including the particular integrated circuit fabrication process and FET device sizes. In accordance with the preferred embodiment of the present invention for a particular fabrication process, the second current mirror has a constant gain of 7/2, which is provided by using an instantiation value of 7 for the second mirror bias FET 171 and an instantiation value of 2 for the second bias FET 161, and the number of FETs having isolated source tied wells is four.

Figure 4:
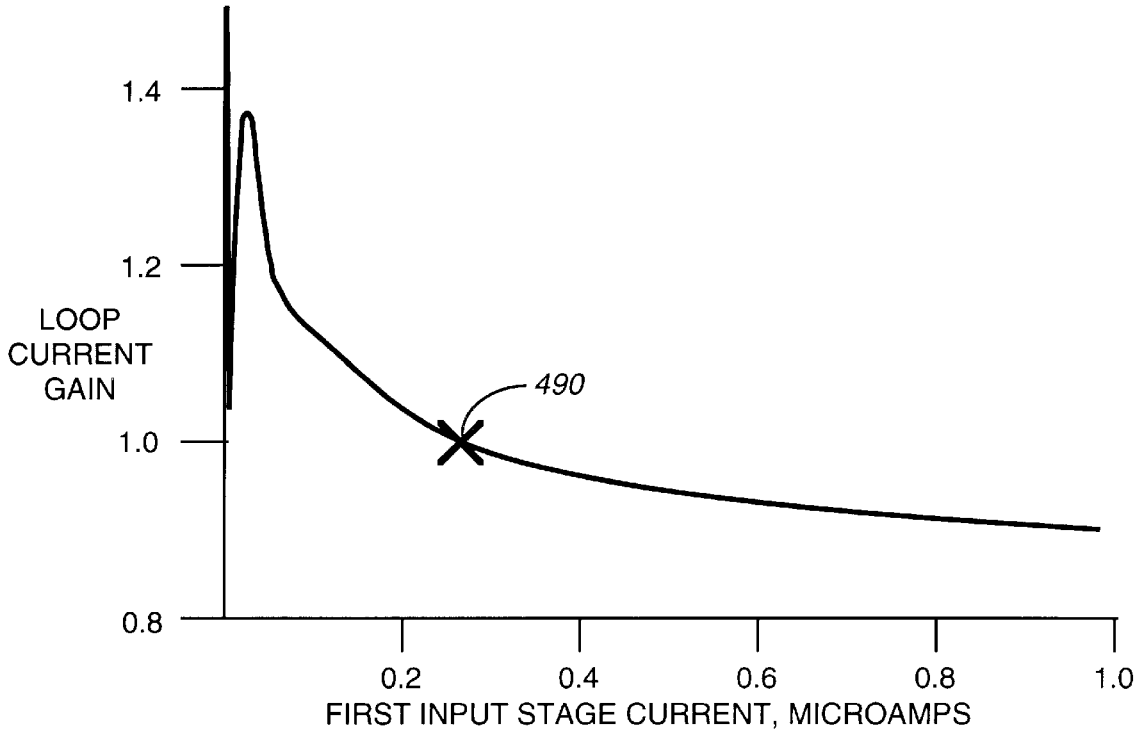
FIG. 4 shows a graph of total open loop current gain versus first current mirror input current of the CMOS current reference circuit, in accordance with the preferred and first alternative embodiments of the present invention.

Referring to FIG. 4, a graph of total open loop current gain versus first current mirror 110 input current of the CMOS current reference circuit 100 is shown, in accordance with the preferred and first alternative embodiments of the present invention. The result of the open loop current gain shown in FIG. 4 is that the CMOS current reference circuit 100 stabilizes at the unity gain point 490 (approximately 0.28 microamperes). The reference bias output 190 generated by the CMOS current reference mirror can be used in other circuits within the same integrated circuit to generate current values precisely determined from the reference current of the CMOS current reference circuit 100, in a manner well known to one of ordinary skill in the art. The reference bias output 190 is useful for generating such current values in n-channel FETs having grounded sources. When a current in another circuit is to be generated by a p-channel FET having a source coupled to the first supply voltage 105, the bias on the first bias node 141 can be used instead.

It will be appreciated that the unity gain point 490 can be varied by changing the current gain of the second current mirror 150. Thus, in a variation of the CMOS current reference circuit 100, the fundamental transistors forming the second bias FET 161 and the second mirror bias FET 171 are selectively activated and de-activated to alter the gain of the second current mirror 150, thereby changing the unity gain point 490, which changes the internal reference current and the associated reference bias output 190 accordingly. The result of the selective activation and de-activation is a controllable CMOS current reference circuit 100, with a selectable reference current and a corresponding selectable output reference bias.

The CMOS current reference circuit 100 provides a very constant current reference over a wide variation of the power supply voltage (the first supply voltage 105 minus the second supply voltage 106). For example, over a power supply voltage variation from two to three volts in the example circuit described herein with reference to FIG. 1, a computer simulation shows that the internal current reference, which is at approximately 290 microamperes, varies by less than one percent. Accordingly, other currents that are determined from the reference bias output 190 will demonstrate essentially the same stability.

Figure 5:
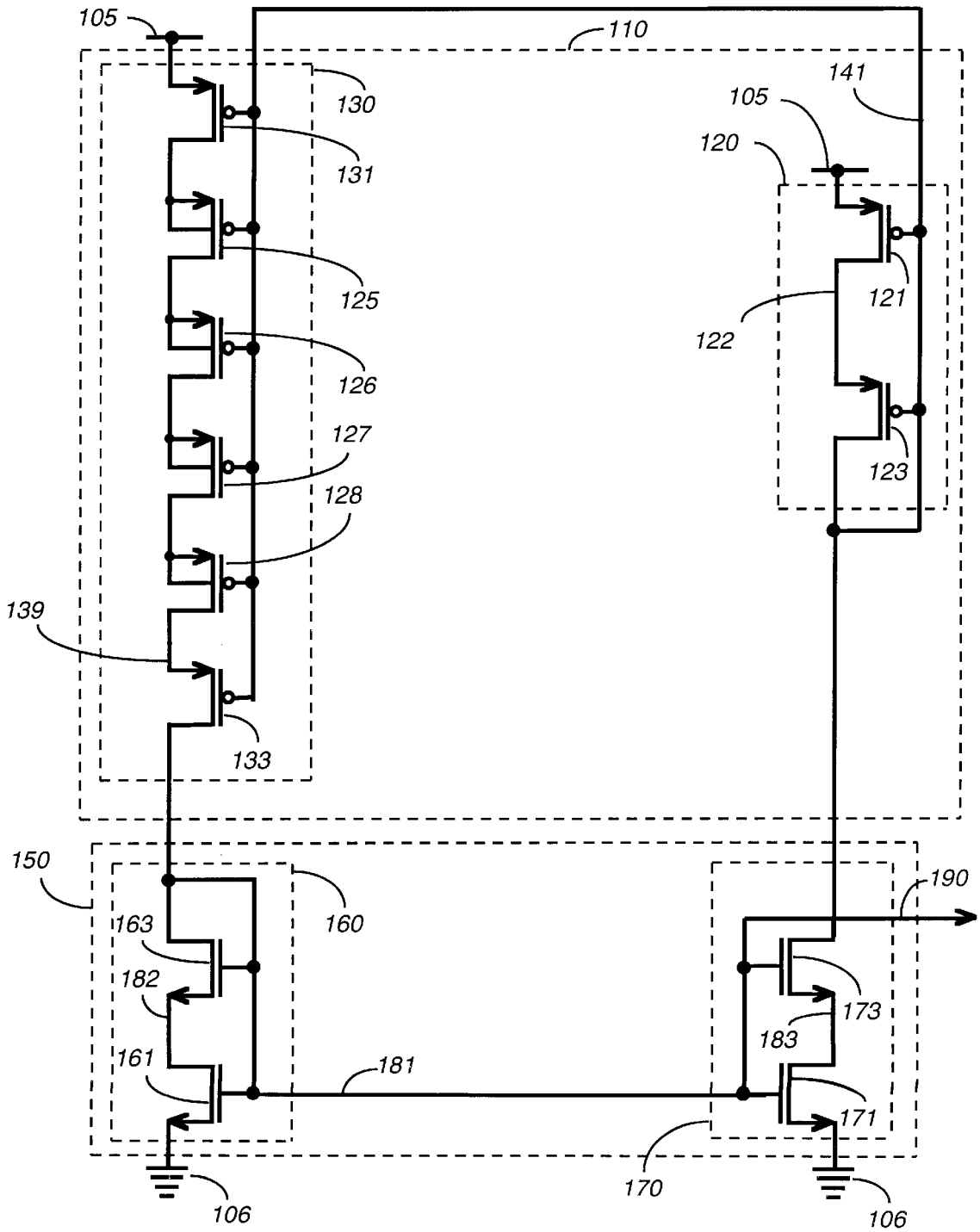
FIG. 5 shows an electrical schematic of a complementary metal oxide semiconductor (CMOS) current reference circuit, in accordance with a second alternative embodiment of the present invention.

Referring to FIG. 5, an electrical schematic of a complementary metal oxide semiconductor (CMOS) current reference circuit 500 is shown, in accordance with a second alternative embodiment of the present invention. The CMOS current reference circuit 500 differs from the CMOS current reference circuit 100 in that the first and second differential OTAs 148, 198 are not included, the first bias node 141 is additionally coupled to the gate of the first output FET 133, and the second bias node 181 is additionally coupled to the gate of the second output FET 173. The CMOS current reference circuit 500 operates in the same manner as the CMOS current reference circuit 100, but generates a less uniform reference output over variations of the power supply voltage. However, the CMOS current reference circuit 500 has the advantage of being simpler than the CMOS current reference circuit 100, and may be useful in some situations where size is a crucial factor and precision is less important.

It will be appreciated that the CMOS current reference circuits 100, 500 can be implemented using more than one first current mirrors 110 and a like number of second current mirrors 150, wherein the output stage 130 of each first current mirror 110 is coupled to the input stage 160 of a second current mirror 150 and the output stage 170 of each second current mirror 150 is coupled to an input stage 120 of a first current mirror 110. Additional current mirrors comprising bias FETs having isolated source tied wells or bodies effectively increase the non-linearity of the curve shown in FIG. 4, and thereby increase the stability of the unity gain point 490, but of course the improvement requires additional offsetting gain within the CMOS current reference circuit feedback loop, and thus additional transistors.

Some of the unique aspects of the CMOS current reference circuits 100, 500 can thus be generically summarized as follows: The CMOS current reference circuit 100, 500 generates a reference bias output 190 that is capable of being used to provide replicate currents in other current mirror circuits within the same integrated circuit, wherein the replicate currents are proportional to an internal reference current generated within the CMOS current reference circuit 100, 500. The CMOS current reference circuit 100, 500 is implemented in one of a bulk silicon wafer technology and a silicon on insulator (SOI) wafer technology. The CMOS current reference circuit 100, 500 comprises at least two current mirrors that comprise a first current mirror 110 and a second current mirror 150. The first current mirror 110 includes a first input stage 120 and a first output stage 130. The first output stage 130 comprises a plurality of field effect transistors (FETs) coupled in a cascode configuration. At least one of the plurality of FETs is a FET having an isolated source tied well when the CMOS current reference circuit 100, 500 is implemented using bulk wafer technology. At least one of the plurality of FETs is a FET having an isolated source tied body when the CMOS current reference circuit 100, 500 is implemented using SOI wafer technology. All FETs in the first current mirror are FETs of a first type. The second current mirror 150 includes a second input stage 160 and a second output stage 170. The second current mirror 150 is coupled to the first current mirror 110 in a current feedback configuration (although this may be through additional mirrors, as described below). All FETs in the first input stage 120 and the first output stage 130 are FETs of a first type (note that the OTAs 148, 198, which are not in the first input stage 120 or the first output stage 130, typically comprise both first and second type FETs).

Another feature of the CMOS current reference circuits 100, 500 is that the instantiation values of the first output FET 133, the first diode connected FET 123, the second output FET 173 and the second diode connected FET 163 are designed such that at least one of a first output instantiation ratio and a second output instantiation ratio is greater than one. The first and second output instantiation ratios are defined herein to be, respectively, the ratio of the instantiation of the first output FET 133 to the instantiation of the first diode connected FET 123, and ratio of the instantiation of the second output FET 173 to the instantiation of the second diode connected FET 163. When first and second output instantiation ratios are provided as described, an excess of leakage currents in at least one of the first and second output FETs 133, 173 over the leakage current in the respective diode connected FET 123, 163 causes the CMOS current reference circuit 100 to self start when the first supply voltage exceeds approximately one half of its final value during a circuit power up. The instantiation values are dependent on the particular fabrication process. In accordance with the preferred embodiment of the present invention, the instantiation values of the first output FET 133 and the second output FET 173 are 16, and the instantiation values of the first diode connected FET 123 and the second diode connected FET 163 are 6, so the first and second output instantiation ratios are both 8/3.

One of ordinary skill in the art will appreciate that a complementary version of the CMOS current reference circuit 100 can be implemented in bulk wafer technology using an N substrate with P wells by changing all FETs in the CMOS current reference circuit 100 to the type opposite that described with reference to FIG. 1 and changing the polarity of the supply voltages 105, 106, and that when an SOI wafer technology is used, a complementary version of the CMOS current reference circuit 100 can be implemented by changing all FETs in the circuit to the type opposite that described with reference to FIG. 1.

Figure 6:
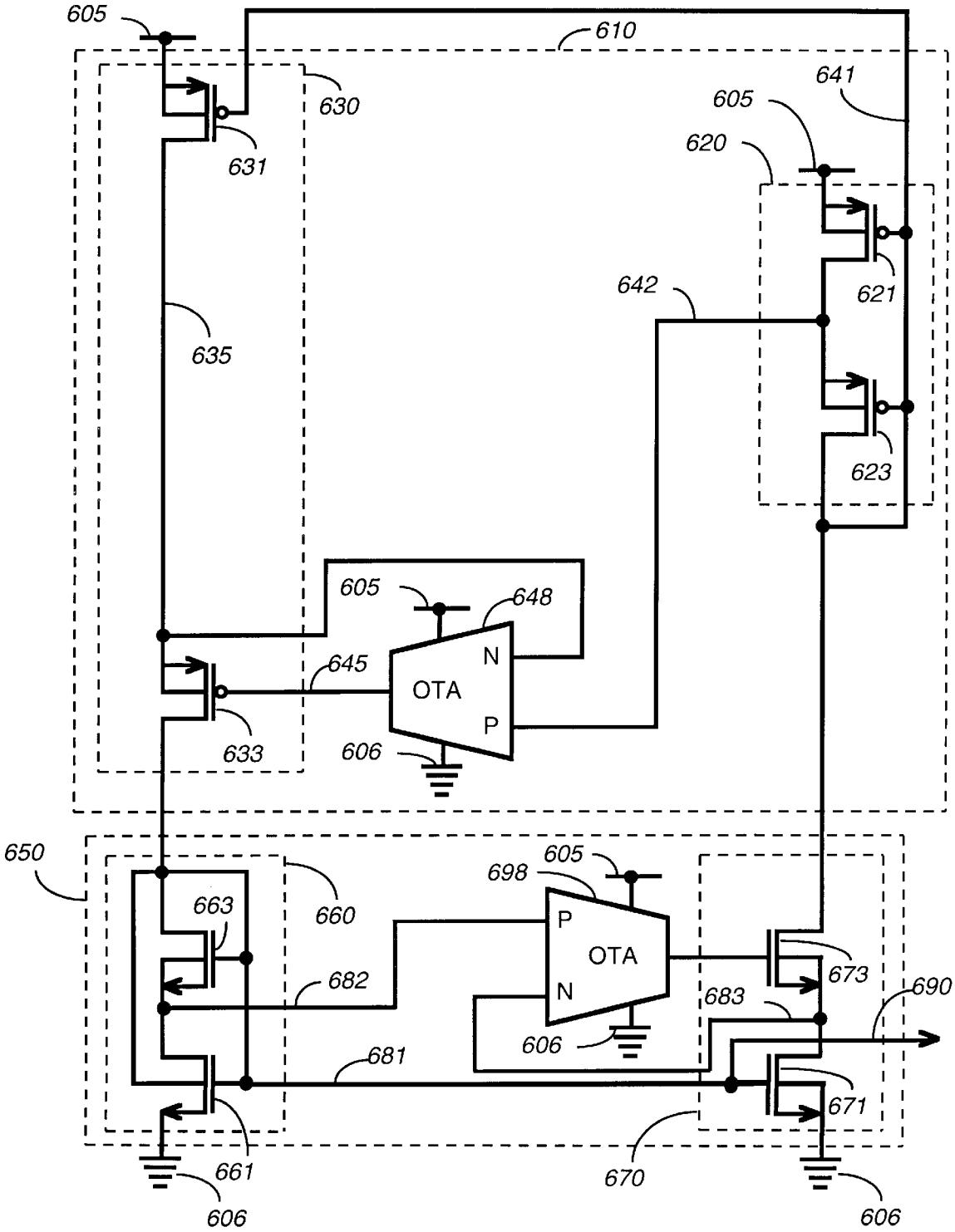
FIG. 6 shows an electrical schematic of a CMOS current reference circuit, in accordance with a third alternative embodiment of the present invention.

Referring to FIG. 6, an electrical schematic of a CMOS current reference circuit 600 is shown, in accordance with a third alternative embodiment of the present invention. The CMOS current reference circuit 600 is preferably implemented using SOI wafer technology. The CMOS current reference circuit 600 produces an internal reference current and a reference bias output 690, but another bias in the circuit can also be used as a reference bias output, as will be described below. The reference bias outputs can be used to generate currents in other current mirror circuits that are precisely proportional to the internal reference current, using conventional current mirror techniques.

The CMOS current reference circuit 600 comprises a first current mirror 650 and a second current mirror 610. The first current mirror 650 comprises a first input stage 660, a first output stage 670, and a first differential OTA 698. The first input stage 660 comprises a first diode connected FET 663 of a first type (n-channel) cascode coupled with a first bias FET 661 of the first type. The first bias FET 661 is configured as a FET having a gate tied body. The term "gate tied body" as used herein means that the body 370 (FIG. 3) of a FET is coupled to the respective gate 322 of the FET, but is not coupled in common with the bodies of any other FETs in formed in the substrate 380, nor with a supply voltage. The bias on the body of the FET having a gate tied body is thereby isolated from the bias of the bodies of all other FETs in the same substrate in which, in accordance with the second alternative embodiment of the present invention, is formed an integrated circuit that includes the CMOS current reference circuit 600. The source of the first bias FET 661 is coupled to a first supply voltage 606, which is the same as the second supply voltage 106 (ground in this example) described above with reference to FIG. 1.

The first output stage 670 comprises a first mirror bias FET 671 of the first type cascode coupled with a first output FET 673 of the first type. The body of the first mirror bias FET 671 is coupled to source of the first mirror bias FET 671, and also to the first supply voltage 606. The gates of the first bias FET 661, the first diode connected FET 663, and the first mirror bias FET 671 are coupled together and share a first bias node 681 which also provides the reference bias output 690. Since the first bias FET 661 is configured in a gate tied body configuration, the bias on the bias node 681 is also coupled to the body of the first bias FET 661. The first current mirror 650 also comprises a first differential operational transconductance amplifier (OTA) 698 that has differential inputs: a non-inverting input that is coupled to a node 682 that includes the source of the first diode connected FET 663 and an inverting input that is coupled to a node 683 that includes the source of the first output FET 673.

Each of the first diode connected FET 663 and the first output FET 673 is configured as a FET having a source tied body, wherein source tied body has the meaning described above with reference to FIG. 3.

The first differential OTA 698 has a first OTA output coupled to the gate of the first output FET 673. The first differential OTA 698 is powered by the first supply voltage 606 and a second supply voltage 605, which is the same as the first supply voltage 105 described above with reference to FIG. 1.

The second current mirror 610 comprises a second input stage 620, a second output stage 630, and a second differential OTA 648. The second input stage 620 comprises a second diode connected FET 623 of a second type (p-channel in this example), cascode coupled with a second bias FET 621 of the second type.

The second output stage 630 comprises a second mirror bias FET 631 of the second type cascode coupled with a second output FET 633 of the second type. The gates of the second bias FET 621, the second diode connected FET 623, and the second mirror bias FET 631 are coupled together and share a second bias node 641.

The source and body of the second bias FET 621, and the source and body of the second mirror bias FET 671 are coupled in common to the second supply voltage 606. However, the second diode connected FET 623 and the second output FET 633 are each configured as a FET having a source tied body.

The second differential OTA 648 has differential inputs: a non-inverting input that is coupled to a node 642 that includes the source of the second diode connected FET 623 and an inverting input that is coupled to a node 635 that includes the source of the second output FET 633. The second differential OTA 648 has a second OTA output 645 coupled to the gate of the second output FET 633. The second differential OTA 648 is powered by the first and second supply voltages 606, 605.

The drain of the first output FET 673 is coupled to the second bias node 641 and the drain of the second output FET 633 is coupled to the first bias node 681, thereby coupling the second current mirror 610 to the first current mirror 650 in a closed loop current feedback configuration.

Figure 7:
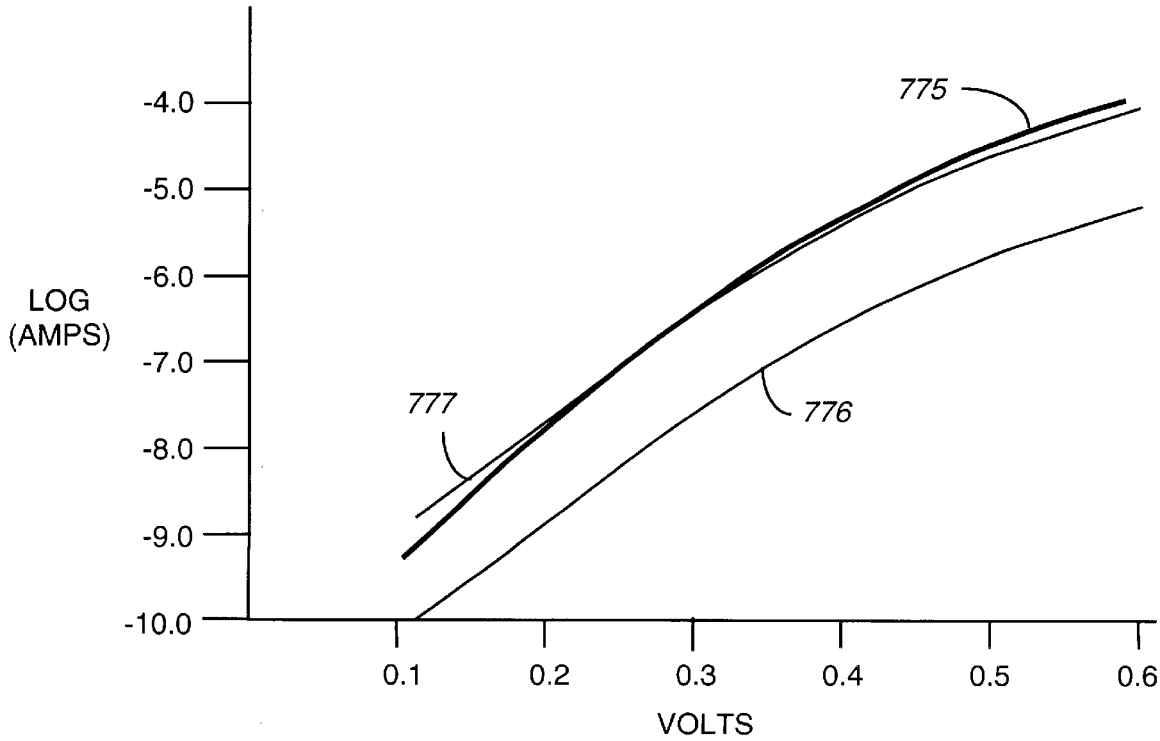
FIG. 7 shows a graph of drain current versus gate-to-source voltage for a first bias FET of the CMOS current reference circuit, in accordance with the third alternative embodiment of the present invention.

Referring to FIG. 7, a graph of drain current versus gate-to-source voltage for the first bias FET 661 is shown under two conditions. Curve 775 plots the drain current versus gate to source voltage for the condition in which the first bias FET 661 is configured in the gate tied body configuration and the source is at zero bias. The behavior of a FET when configured in the gate tied body configuration is discussed in pages 166–168 of a book by J. P. Colinge, "Silicon on Insulator Technology: Materials to VLSI," published by Klower Academic Press, 1991. Curve 776 plots the drain current versus gate-to-source voltage for a condition that would exist if the first bias FET 661 were configured in the source tied body configuration, with the source and body at zero bias, and which does exist for the first mirror bias FET 671, which is configured in the source tied body configuration, with the source and body at zero bias. It will be appreciated that, as shown by curves 775, 776, at any given gate-to-source voltage, the drain current of the first bias FET 661 configured in the gate tied body configuration is much higher than the drain current in the source tied body configuration. It will be further appreciated that if the instantiation of the first mirror bias FET 671, which is configured in the source tied body configuration, were increased by a sufficient factor over the unity instantiation of the first bias FET 661, the curve 776 would become curve 777 and would cross curve 775 at approximately 0.3 volts, as shown in FIG. 7. It will be appreciated that a current ratio of curve 777 to curve 775 is greater than one at voltages below those where the curves 775, 777 cross, is less than one at voltages above those where the curves 775, 777 cross, and is one where the curves 775, 777 cross.

In accordance with the third alternative embodiment of the present invention, a necessary gain that causes the curve 776 to cross the curve 775 is determined at the time of system design that guarantees that a current ratio of one exists at essentially one and only one voltage on the first bias node 681, for all possible voltages from zero to a maximum supply voltage. The necessary gain can be achieved by various combinations of bias FET instantiation ratios of the first and second current mirrors 650, 610. A bias FET instantiation ratio is defined herein to be the ratio of instantiation of a bias mirror FET to the bias FET in the same mirror. For example, a necessary gain is 16. (Other necessary gains of approximately the same value could possibly exist, such as 15 or 17, if they achieve the criteria described). This gain could be achieved by bias FET instantiation ratios in the first and second current mirrors 650, 610, respectively, of 16 and 1, 8 and 2, 4 and 4, 2 and 8, or 1 and 16. In accordance with the third alternative embodiment of the present invention, the instantiation ratios in the first and second current mirrors 650, 610 are 4 and 4, which reduces the number of transistors used in the CMOS current reference 600 in comparison to the other choices. The necessary gain can be achieved by combinations of bias FET instantiation ratios when there are more than two current mirrors in the CMOS current reference, by techniques well known to one of ordinary skill in the art.

Computer simulation of the performance of the CMOS current reference circuit 600 shows that the internal reference current varies less than 1.5% when the supply voltage is varied from approximately 0.8 volts to 3.0 volts.

Figure 8:
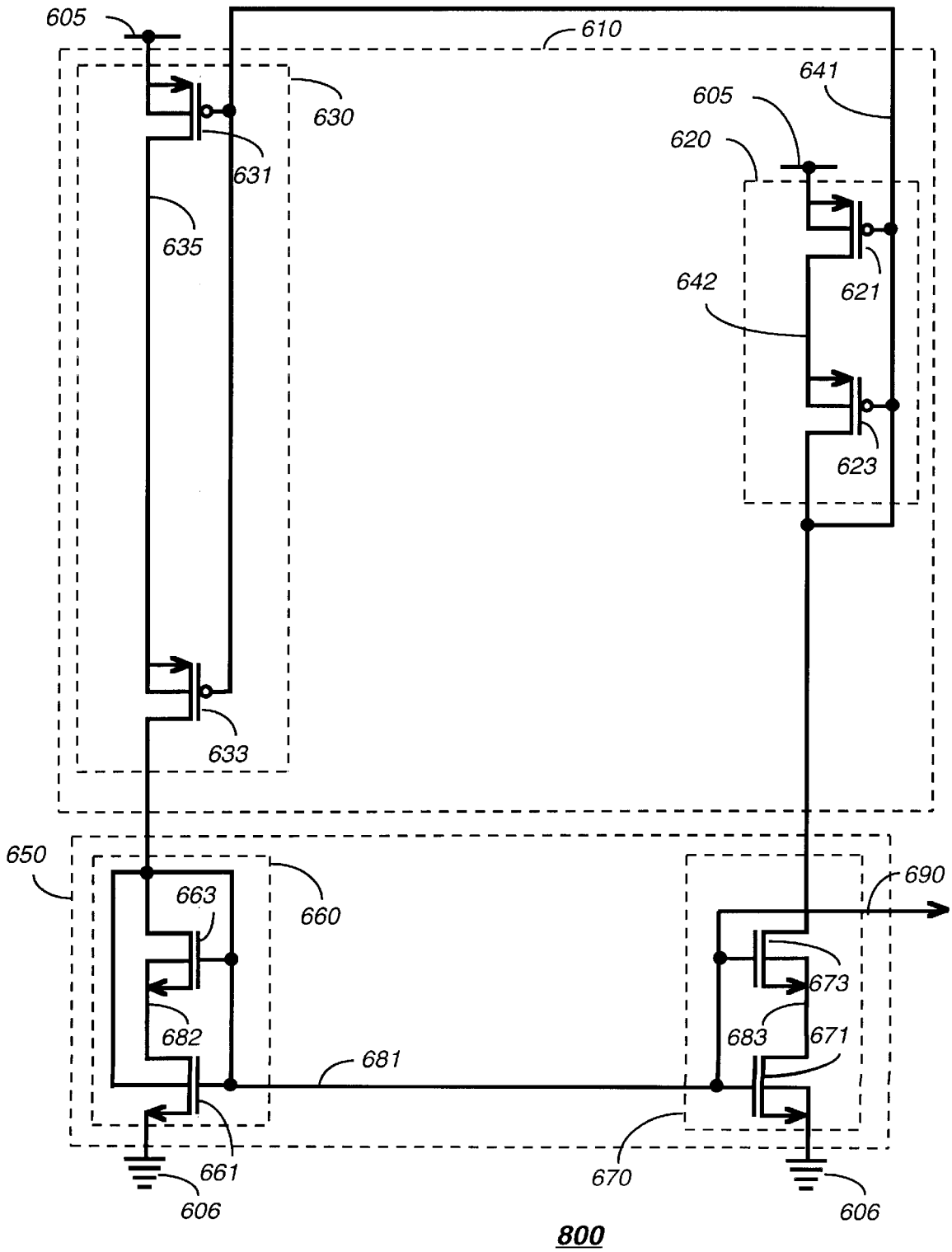
FIG. 8 shows an electrical schematic of a CMOS current reference circuit, in accordance with a fourth alternative embodiment of the present invention.

Referring to FIG. 8, an electrical schematic of a CMOS current reference circuit 800 is shown, in accordance with a fourth alternative embodiment of the present invention. The first and second differential OTAs 698, 648 have been removed from the CMOS current reference circuit 600 in a manner analogous with the removal of the first and second differential OTAs 148, 198 as described with reference to FIGS. 5 and 1. The effect of implementing the CMOS current reference circuit 800 without the first and second differential OTAs, as shown by computer simulation, is that the internal reference current varies approximately 20% as the voltage supply is varied between 1.0 and 3.0 volts. The CMOS current reference circuit 800 has the advantage of being simpler than the CMOS current reference circuit 600, and may be useful in some situations where size is a crucial factor and reference current variation with supply voltage variation is less important. The addition of only the first differential OTA 198 into the CMOS current reference circuit 800 is shown by simulation to reduce the variation of the internal current reference to approximately 3.5% as the voltage supply is varied between 1.0 and 3.0 volts.

It will be appreciated that the CMOS current reference circuits 600, 800 can be implemented using more than one first current mirrors 650 and a like number of second current mirrors 610, wherein the output stage 670 of each first current mirror 650 is coupled to the input stage 620 of a second current mirror 610, and the output stage 630 of each second current mirror 610 is coupled to an input stage 660 of a first current mirror 650. Furthermore, any of the second current mirrors can include a second bias FET having a gate tied body which is coupled to the second supply voltage. Such additional bias FETs having gate tied bodies effectively increase the current gain difference of the two curves 775, 777 shown in FIG. 7, and thereby increase the stability of the unity gain point, but of course the improvement requires additional gain within the CMOS current reference circuit feedback loop, and thus additional transistors.

Some of the unique aspects of the CMOS current reference circuits 600, 800 can thus be generically summarized as follows: The CMOS current reference circuit 600, 800 generates a reference bias output 690 that is capable of being used to provide replicate currents in other current mirror circuits within the same integrated circuit, wherein the replicate currents are proportional to an internal reference current generated within the CMOS current reference circuit 600, 800. The CMOS current reference circuit 600, 800 is implemented in silicon on insulator (SOI) wafer technology, comprising at least two current mirrors that comprise a first current mirror 650 and a second current mirror 610. The first current mirror 650 comprises a first input stage 660 comprising a first bias field effect transistor (FET) 661 that is configured as a FET having a gate tied body, and a first output stage 670 comprising a first mirror bias FET 671 having a body coupled to a first supply voltage 606. All FETs in the first input stage and first output stage are of a first type. The second current mirror 610 comprises a second input stage 620 and a second output stage 630. All FETs in the second input stage 620 and second output stage 630 are of a second type. The second current mirror 610 is coupled to the first current mirror 650 in a closed loop current feedback configuration.

Another feature of the CMOS current reference circuits 600, 800 is that the instantiation values of the first output FET 673, the first diode connected FET 663, the second output FET 633 and the second diode connected FET 623 are designed such that at least one of a first output instantiation ratio and a second output instantiation ratio is greater than one. The first and second output instantiation ratios are defined herein to be, respectively, the ratio of the instantiation of the first output FET 673 to the instantiation of first diode connected FET 663, and ratio of the instantiation of second output FET 633 to the instantiation of second diode connected FET 623. When first and second output instantiation ratios are provided as described, the CMOS current reference circuits 600, 800 self start when the second supply voltage exceeds approximately one half of its final value during a circuit power up. In accordance with the third and fourth alternative embodiments of the present invention, the instantiation values of the first output FET 673 and the second output FET 633 are 4, and the instantiation values of the first diode connected FET 663 and the second diode connected FET 623 are 1.

It will be appreciated that the CMOS current reference circuits 100, 500, 600, 800 provide a current reference within an integrated circuit without using any resistors, thereby providing the benefits of smaller physical size and lower power consumption while still providing a current reference of desirable precision.

The description "essentially one and only one voltage" is used above with reference to criteria for designing the CMOS current reference circuits 100, 500, 600, 800, because the "one voltage" will have instantaneous noise variations of an amount below the nominal value of the one voltage (typically two orders or more of magnitude below the nominal value), but such variations have no significant impact on the benefits provided by the inventions described herein.

Referring to FIG. 9, an electrical block diagram of a radio 900 is shown, in accordance with the preferred and alternative embodiments of the present invention. The radio 900 is a selective call radio that includes an antenna 902 for intercepting a radiated signal 901. The antenna 902 converts the radiated signal 901 to a conducted radio signal 903 that is coupled to a receiver 904 wherein the conducted radio signal 903 is received. The receiver 904 is a zero IF (intermediate frequency) receiver that comprises a demodulator 906 and one of the CMOS current reference circuits 100, 500, 600, 800. The demodulator 906 and the one of the CMOS current reference circuits 100, 500, 600, 800 are implemented in a single integrated circuit 908 which includes essentially all of the functions of the receiver 904. The reference bias output(s) that are generated by the one of the CMOS current reference circuits 100, 500, 600, 800, reference currents having predetermined values are generated that are used within the receiver 904 and within the demodulator 906. These reference currents establish linear gain functions and bias levels 906 that are used to produce precise frequency conversion of the received signal and to generate a baseband demodulated signal 905 that is coupled to a controller circuit 950. The controller circuit 950 is coupled to a display 924, an alert 922, a set of user controls 920, and an electrically erasable read only memory (EEPROM) 926. The controller circuit 950 comprises a digital conversion circuit 910 and a microprocessor 960. The demodulated signal 905 is coupled to the digital conversion circuit 910 wherein it is converted to a binary signal that is coupled to the microprocessor 960. The microprocessor 960 is coupled to the EEPROM 926 for storing an embedded address stored therein during a maintenance operation and for loading the embedded address during normal operations of the radio 900. The microprocessor 960 is a conventional microprocessor comprising a central processing unit (CPU), a read only memory (ROM), and a random access memory (RAM).

A message processor function of the microprocessor 960 decodes outbound words and processes an outbound message when an address received in the address field of the outbound signaling protocol matches the embedded address stored in the EEPROM 926, in a manner well known to one of ordinary skill in the art for a selective call radio. An outbound message that has been determined to be for the radio 900 by the address matching is processed by the message processor function according to the contents of the outbound message and according to modes set by manipulation of the set of user controls 920, in a conventional manner. An alert signal is typically generated when an outbound message includes user information. The alert signal is coupled to the alert device 922, which is typically either an audible or a silent alerting device.

When the outbound message includes alphanumeric or graphic information, the information is displayed on the display 924 in a conventional manner by a display function at a time determined by manipulation of the set of user controls 920. The CMOS current reference circuit 100, 500, 600, 800 can also be used in other integrated circuits within the radio 900, and will provide the same benefits of smaller size and lower power consumption in comparison to prior art circuits.

While the CMOS current reference circuits 100, 500, 600, 800 have been described above as being used in conjunction with a radio receiver, it will be appreciated that the CMOS current reference circuits 100, 500, 600, 800 are equally beneficial for use in many other electronic devices, such as CMOS current reference circuits for a magnetic disk drive head circuit or a compact disk read only memory (CD-ROM) optical head circuit.

By now it should be appreciated that there have been provided unique CMOS current reference circuits in accordance with the preferred and alternative embodiments of the present invention which provide useful benefits in comparison to prior art current reference circuits. The CMOS current reference circuits in accordance with the preferred and alternative embodiments of the present invention provide one or more reference bias outputs that are capable of replicating a multiple of a reference current generated within the CMOS current reference circuits. The CMOS current reference circuits in accordance with the preferred and alternative embodiments of the present invention include no resistors, and are self starting.

We claim:

1. An electronic device that comprises A complementary metal oxide semiconductor (CMOS) current reference circuit implemented in bulk wafer technology that generates a reference bias output that is capable of being used to provide replicate currents in other current mirror circuits, comprising:

a first current mirror, comprising a first input stage and a first output stage, wherein the first output stage comprises a plurality of field effect transistors (FETs) coupled in a cascade configuration, and wherein at least one of the plurality of FETs is a FET having an isolated source tied well, and wherein the first input stage comprises a first diode connected FET that is cascode coupled with a first bias FET, and wherein a source of the first bias FET is coupled to a first supply voltage, and wherein the plurality of FETs comprises a first mirror bias FET having a source coupled to a first supply voltage, and a first output FET, and wherein gates of the first bias FET, the first diode connected FET, the first mirror bias FET, and the FET having an isolated source tied well share a first bias node, and wherein said FETs in the first input stage and first output stage are of a first type; and a second current mirror, comprising a second input stage and a second output stage, and wherein the first current mirror and the second current mirror are coupled in a closed loop current feedback configuration, and wherein the second input stage comprises a second diode connected FET cascode coupled with a second bias FET, wherein a source of the second bias FET is coupled to a second supply voltage, and wherein the second output stage comprises a second mirror bias FET cascode coupled with a second output FET, wherein a source of the second mirror bias FET is coupled to a second supply voltage, and wherein gates of the second diode connected FET, the second bias FET, and the second mirror bias FET share a second bias node, and wherein a drain of the first output FET is coupled to the second bias node and a drain of the second output FET is coupled to the first bias node, and wherein said FETs in the second input stage and the second output stage are of a second type.

2. A complementary metal oxide semiconductor (CMOS) current reference circuit implemented in bulk wafer technology that generates a reference bias output that is capable of being used to provide replicate currents in other current mirror circuits, comprising:

a first current mirror, comprising a first input stage and a first output stage, wherein the first output stage comprises a plurality of field effect transistors (FETs) coupled in a cascade configuration, and wherein at least one of the plurality of FETs is a FET having an isolated source tied well, and wherein the first input stage comprises a first diode connected FET that is cascode coupled with a first bias FET, and wherein a source of the first bias FET is coupled to a first supply voltage, and wherein the plurality of FETs comprises a first mirror bias FET having a source coupled to a first supply voltage, and a first output FET, and wherein gates of the first bias FET, the first diode connected FET, the first mirror bias FET, and the FET having an isolated source tied well share a first bias node, and wherein said FETs in the first input stage and first output stage are of a first type; and a second current mirror, comprising a second input stage and a second output stage, and wherein the first current mirror and the second current mirror are coupled in a closed loop current feedback configuration, and wherein the second input stage comprises a second diode connected FET cascode coupled with a second bias FET, wherein a source of the second bias FET is coupled to a second supply voltage, and wherein the second output stage comprises a second mirror bias FET cascode coupled with a second output FET, wherein a source of the second mirror bias FET is coupled to a second supply voltage, and wherein gates of the second diode connected FET, the second bias FET, and the second mirror bias FET share a second bias node, and wherein a drain of the first output FET is coupled to the second bias node and a drain of the second output FET is coupled to the first bias node, and wherein said FETs in the second input stage and the second output stage are of a second type.

3. The CMOS current reference circuit according to claim 2, wherein a first differential operational transconductance amplifier (OTA) has differential inputs coupled to a source of the first diode connected FET and the source of the first output FET, and has a first OTA output coupled to a gate of the first output FET, and wherein a second differential OTA has differential inputs coupled to a source of the second diode connected FET and the source of the second output FET, and has a second OTA output coupled to a gate of the second output FET.

4. The CMOS current reference circuit according to claim 2, wherein a gate of the first output FET shares the first bias node, and wherein a gate of the second output FET shares the second bias node.

5. A complementary metal oxide semiconductor (CMOS) current reference circuit that generates a reference bias output that is capable of being used to provide replicate currents in other current mirror circuits, wherein the replicate currents are proportional to an internal reference current generated within the CMOS current reference circuit, and wherein the CMOS current reference source is implemented in a silicon on insulator technology, comprising:

a first current mirror, comprising a first input stage comprising a first bias field effect transistor (FET) that is configured as a FET having a gate tied body, and a first output stage comprising a first mirror bias FET having a body coupled to a first supply voltage, wherein the first bias FET and first mirror bias FET share a first bias node and share a first common source node, and wherein said FETs in the first input stage and first output stage are of a first type; and a second current mirror, comprising a second input stage that comprises a second bias FET and a second output stage that comprises a second mirror bias FET, wherein the second bias FET and second mirror bias FET share a second bias node and share a second common source node, and wherein said FETs in the second input stage and second output stage are of a second type, and wherein the second current mirror is coupled to the first current mirror in a closed loop current feedback configuration in which a drain of a first output FET of the first output stage is coupled to the second bias node and a drain of a second output FET of the second output stage is coupled to the first bias node.

6. An electronic device that comprises a complementary metal oxide semiconductor (CMOS) current reference circuit that generates a reference bias output that is capable of being used to provide replicate currents in other current mirror circuits, wherein the replicate currents are proportional to an internal reference current generated within the CMOS current reference circuit, and wherein the CMOS current reference source is implemented in a silicon on insulator technology, comprising:

a first current mirror, comprising a first input stage comprising a first bias field effect transistor (FET) that is configured as a FET having a gate tied body, and a first output stage comprising a first mirror bias FET having a body coupled to a first supply voltage, wherein the first bias FET and first mirror bias FET share a first bias node and share a first common source node, and wherein said FETs in the first input stage and first output stage are of a first type; and a second current mirror, comprising a second input stage that comprises a second bias FET and a second output stage that comprises a second mirror bias FET, wherein the second bias FET and second mirror bias FET share a second bias node and share a second common source node, and wherein said FETs in the second input stage and second output stage of a second type, and wherein the second current mirror is coupled to the first current mirror in a closed loop current feedback configuration in which a drain of a first output FET of the first out stage is coupled to the second bias node and a drain of a second output FET of the second output stage is coupled to the first bias node.

7. The CMOS current reference circuit according to claim 5, wherein the CMOS current reference circuit includes no resistors.

8. The CMOS current reference circuit according to claim 5, wherein a necessary gain is determined that guarantees that an open loop output to input current ratio of one exists at essentially only one voltage on the first bias node, for all possible voltages from zero to a maximum supply voltage, and wherein the necessary gain is achieved by combinations of bias FET instantiation ratios of the at least two current mirrors.

9. The CMOS current reference circuit according to claim 5, wherein an input stage of one of the at least two current mirrors comprises fundamental transistors forming a bias FET and fundamental transistors forming a mirror bias FET, wherein the fundamental transistors are selectively activated and de-activated to alter an output to input current gain of one of the at least two current mirrors.

10. The CMOS current reference circuit according to claim 5, wherein an output instantiation ratio of one of the at least two current mirrors in the CMOS current reference circuit is greater than one.

11. The CMOS current reference circuit according to claim 5, wherein the first input stage comprises a first diode connected FET, cascode coupled with the first bias FET, wherein the first output stage comprises a first output FET, cascode coupled with the first mirror bias FET, and wherein the first common source node and a body of the first mirror bias FET are coupled to the first supply voltage, and wherein a gate of the first diode connected FET shares the first bias node, and wherein the second input stage comprises a second diode connected FET, cascode coupled with a second bias FET, and wherein the second output stage comprises a second mirror bias FET, cascode coupled with a second output FET, and wherein a gate of the second diode connected FET shares the second bias node.

12. The CMOS current reference circuit according to claim 11, wherein a first differential operational transconductance amplifier (OTA) has differential inputs coupled to a source of the first diode connected FET and the source of the first output FET, and has a first OTA output coupled to a gate of the first output FET, and wherein a second differential OTA has differential inputs coupled to a source of the second diode connected FET and the source of the second output FET, and has a second OTA output coupled to a gate of the second output FET.

13. The CMOS current reference circuit according to claim 11, wherein a gate of the first output FET shares the first bias node, and wherein a gate of the second output FET shares the second bias node.

14. The CMOS current reference circuit according to claim 2, wherein an output instantiation ratio of one of the at least two current mirrors in the CMOS current reference circuit is greater than one.

* * * * *